US011482349B1

(12) United States Patent
Lee

(10) Patent No.: US 11,482,349 B1
(45) Date of Patent: Oct. 25, 2022

(54) CABLE WITH NON-CIRCULAR GROUND WIRES

(71) Applicant: James Cheng Lee, La Habra, CA (US)

(72) Inventor: James Cheng Lee, La Habra, CA (US)

( * ) Notice: Subject to any disclaimer, the term of this patent is extended or adjusted under 35 U.S.C. 154(b) by 0 days.

(21) Appl. No.: 17/369,576

(22) Filed: Jul. 7, 2021

Related U.S. Application Data

(60) Provisional application No. 63/191,161, filed on May 20, 2021.

(30) Foreign Application Priority Data

Jul. 6, 2021 (CN) ..... 202110760202.6

(51) Int. Cl.

| | |
|---|---|
| ***H01B 5/02*** | (2006.01) |
| ***H01B 7/08*** | (2006.01) |
| ***H01B 7/00*** | (2006.01) |
| *H01B 11/00* | (2006.01) |
| *H01B 7/18* | (2006.01) |
| *H01B 7/02* | (2006.01) |

(52) U.S. Cl.
CPC ..... *H01B 7/0009* (2013.01); *H01B 7/0216* (2013.01); *H01B 7/1805* (2013.01); *H01B 11/002* (2013.01)

(58) Field of Classification Search
CPC ..... H01B 5/02; H01B 7/08
See application file for complete search history.

(56) References Cited

U.S. PATENT DOCUMENTS 3,816,644 A * 6/1974 Giffel ..... H01B 9/028 174/115
3,829,603 A * 8/1974 Hansen ..... H01B 9/025 174/115
7,166,802 B2 * 1/2007 Cusson ..... H01B 7/20 174/105 R (Continued)

FOREIGN PATENT DOCUMENTS

CN 212647909 U 3/2021
JP 2004-087198 * 3/2004

OTHER PUBLICATIONS

Taiwan Patent Office, Office Action, Patent Application No. TW110124710, dated Mar. 15, 2022.

*Primary Examiner* — Chau N Nguyen
(74) *Attorney, Agent, or Firm* — Lin & Associates Intellectual Property, Inc.

(57) ABSTRACT

A cable with a non-circular ground wire is provided, including two wires, two ground wires, and an insulating tape; wherein the inner sides of the wires are in contact with each other; the ground wires are respectively arranged on two opposite sides of the wires; each ground wire at least includes a first side surface, a second side surface, and a third side surface; the first and second side surfaces respectively contact the outer surfaces of the two wires, and the shapes of the first side surface and the second side surface respectively correspond to the shapes of the outer surfaces of the two wires; the insulating tape covers the outer surfaces of the wires and the third side surfaces of the ground wires. Thereby, the mechanical properties of the cable of the present invention, such as small impedance variation of high-frequency signal transmission, transmission stability, structural flexibility and bending, can be significantly improved.

5 Claims, 4 Drawing Sheets

(56) References Cited

U.S. PATENT DOCUMENTS

| | | | | |
|---|---|---|---|---|
| 7,501,577 | B2 * | 3/2009 | Fisher | H01B 9/027<br>174/113 R |
| 2012/0145429 | A1 * | 6/2012 | Nordin | H01B 11/20<br>174/34 |

* cited by examiner

CABLE WITH NON-CIRCULAR GROUND WIRES

CROSS-REFERENCE TO RELATED APPLICATIONS

This application claims the benefit of the U.S. Provisional Patent application No. 63/191,161, filed on May 20, 2021, and CN Patent application No. 202110760202.6, filed on Jul. 6, 2021, which are hereby incorporated by reference as if fully set forth herein.

BACKGROUND OF THE INVENTION

1. Field of the Invention

The present invention relates generally to a cable, and more particularly, to a cable with non-circular ground wires.

2. The Prior Arts

FIG. 1 is a cross-sectional view of a conventional cable 100. As shown in FIG. 1, the conventional cable 100 includes two wires 110, a ground wire 120 and an insulating tape 130. Each wire 110 includes a conductor 111 and an insulating layer 112, and the insulating layer 112 covers the outer surface of the conductor 111. The ground wire 120 is a conductor. The insulating tape 130 includes an inner layer 131 and an outer layer 132. The inner layer 131 covers the outer surface of the insulating layers 112 and the outer surface of the ground wire 120, and the outer layer 132 covers the outer surface of the inner layer 131.

However, the cross-sections of the wires 110 and the ground wire 120 are circular, so that the wires 110 and the ground wire 120 are in contact with each other only at points, and the contact area is small, resulting in poor bonding between the wires 110 and the ground wire 120. Therefore, during the process of covering the outer surface of the wires 110 and the outer surface of the ground wire 120 with the insulating tape 130, the tension of the insulating tape 130 will directly squeeze the wires 110 and the ground wires 120. The assembly of the wires 110 and the ground wire 120 is not sufficiently tight, and is easy to loosen, deflect and deform, which will result in a complete change of the relative positions of the wires 110 and the ground wire 120. Therefore, the conventional cable 100 has the following problems: first, the signal heat loss is high, causing unstable high-frequency signal transmission; second, the overall structure strength is insufficient; third, the flexibility and bending of the cable 100 and the mechanical properties such as the concentricity of the wires 110 are reduced; fourth, the distance between the two conductors 111 varies, so the impedance variation is large, resulting in unstable impedance; fifth, the heat dissipation effect is poor.

SUMMARY OF THE INVENTION

A primary objective of the present invention is to provide a cable with a non-circular ground wire, the wires and the ground wire fit well, so that the relative position of the wires and the ground wire remains unchanged.

To achieve the foregoing objective, the present invention provides a cable with a non-circular ground wire, including two wires, two ground wires, and an insulating tape; wherein the inner sides of the wires are in contact with each other; the ground wires are respectively arranged on two opposite sides of the wires; each ground wire at least includes a first side surface, a second side surface, and a third side surface; the first and second side surfaces being arc-shaped, complementary to and respectively in contact with the outer surfaces of the two wires, and the shapes of the first side surface and the second side surface respectively correspond to the shapes of the outer surfaces of the two wires; the insulating tape covers the outer surfaces of the wires and the third side surfaces of the ground wires.

In some embodiments, the cross-section of each wire is circular, and the first side surface and the second side surface of the ground wires are arc-shaped.

In some embodiments, the diameters of the wires are equal, and the arc lengths of the first side surface and the second side surface of the ground wires are equal.

In some embodiments, the arc length of the first side surface and the second side surface of each ground wire is equal to ¼ to 1/12 of the circumference of each wire.

In some embodiments, a first angle is formed between the first side surface and the second side surface of the ground wire, and a second angle is formed between the first side surface and the third side surface of the ground wire, a third angle is formed between the second side surface and the third side surface of the ground wire, the first angle is greater than the second angle and the third angle, and the second angle and the third angle are equal.

In some embodiments, the shape of an inner surface of the insulating tape corresponds to the shape of the combination of the outer surfaces of the wires and the third side surfaces of the ground wires.

In some embodiments, the cross-section of each wire is circular, the third side surface of the ground wire is arc-shaped and the overall surface is in contact with the inner surface of the insulating tape, and the cross-section of the insulating tape is elliptical.

In some embodiments, a first rounded corner is formed between the first side surface and the second side surface of the ground wire, and a second rounded corner is formed between the first side surface and the third side surface of the ground wire, and a third rounded corner is formed between the second side surface and the third side surface of the ground wire.

In some embodiments, the angles of the first round corner, the second round corner, and the third round corner are equal.

In some embodiments, a first rounded corner is formed between the first side surface and the second side surface of the ground wire, and the third side surface of the ground wire includes a fourth side surface, a fourth round corner, and a fifth side surface, a second rounded corner is formed between the first side surface and the fourth side surface of the ground wire, and a third rounded corner is formed between the second side surface and the fifth side surface of the ground wire.

In some embodiments, the positions of the first side surface and the fifth side surface of the ground wire correspond to each other and the shapes are symmetrical, and the positions of the second side surface and the fourth side surface of the ground wire correspond to each other and the shapes are symmetrical; the first and fourth rounded corners of the ground wire are diagonal corners and the angles are equal, and the second and third rounded corners of the ground wire are diagonal corners and the angles are equal.

In some embodiments, each ground wire includes a bushing and a conductor; the bushing has a first side surface and a second side surface, one side of the bushing is recessed with a groove, and the conductor is embedded in the groove and protrudes from one side of the bushing, and one side of the conductor and one side of the bushing are jointly defined as the third side.

In some embodiments, the cross-section of the inner surface of the groove is arc-shaped, and the cross section of the conductor is circular.

In some embodiments, the bushing is made of polytetrafluoroethylene (PTFE), polyethylene (PE), or polyvinyl chloride (PVC).

In some embodiments, each wire includes a conductor and an insulating layer, and the insulating layer covers an outer surface of the conductor; wherein, the first side surface and the second side surface of the ground wire are complementary to and respectively in contact with the outer surfaces of the insulating layers, and the shape of the first side surface and the shape of the second side surface of each ground wire respectively correspond to the shapes of the outer surface of the insulating layers; and wherein the insulating tape covers the outer surfaces of the insulating layers and the third side surfaces of the ground wires.

In some embodiments, the insulating tape includes at least an inner layer and an outer layer; the inner layer covers the outer surfaces of the wires and the third side surfaces of the ground wires, and the outer layer covers the outer surface of the inner layer.

In some embodiments, the inner layer is made of aluminum foil Mylar, and the outer layer is made of polyethylene terephthalate.

The effect of the present invention is that the cross-section of the ground wires is a non-circular shape, the wires and the ground wires can contact each other by surface contact with matching shapes. The contact area is large, so that an excellent fit can be achieved. Thereby, the mechanical properties of the cable of the present invention, such as small impedance variation of high-frequency signal transmission, transmission stability, structural flexibility and bending properties, can be significantly improved.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

Figure 1:
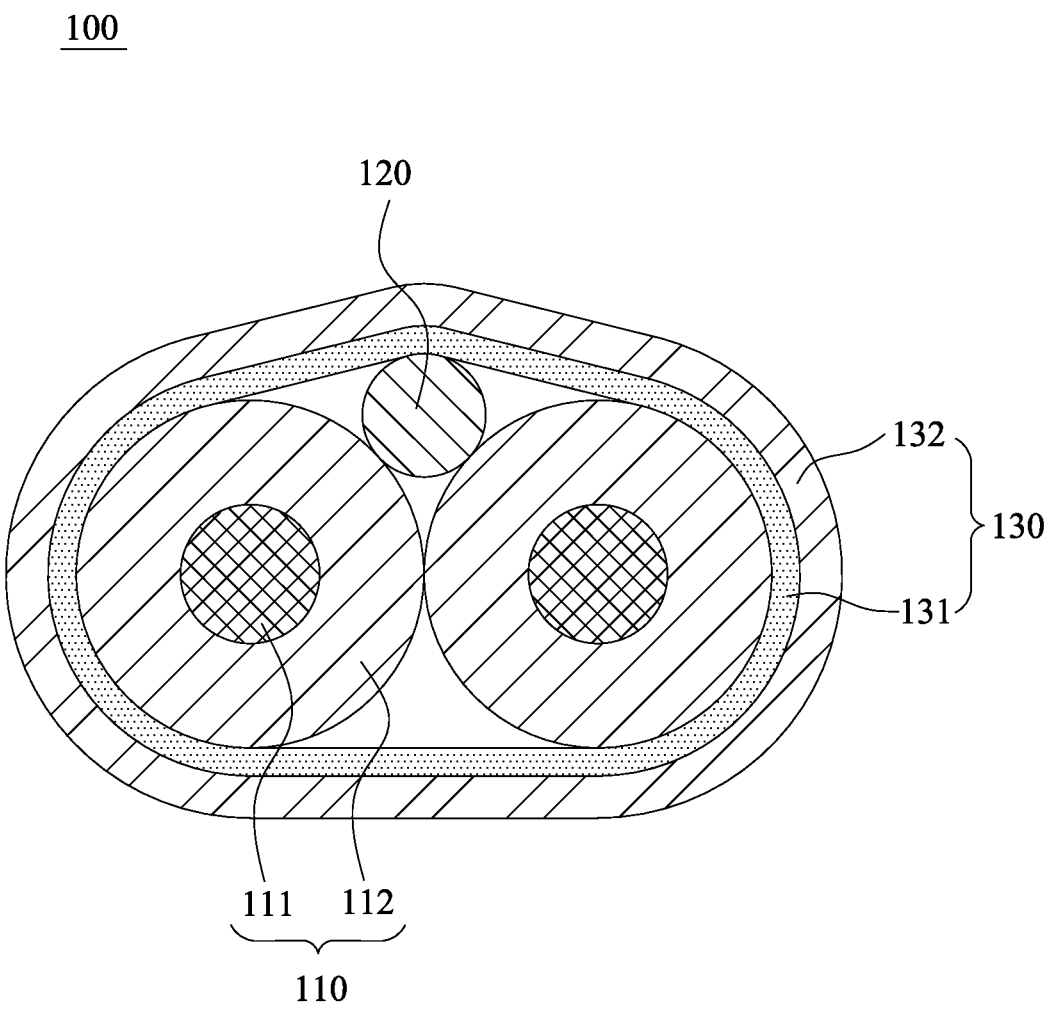
FIG. 1 (Prior Art)
FIG. 1 is a cross-sectional view of a conventional cable.
Figure 2:
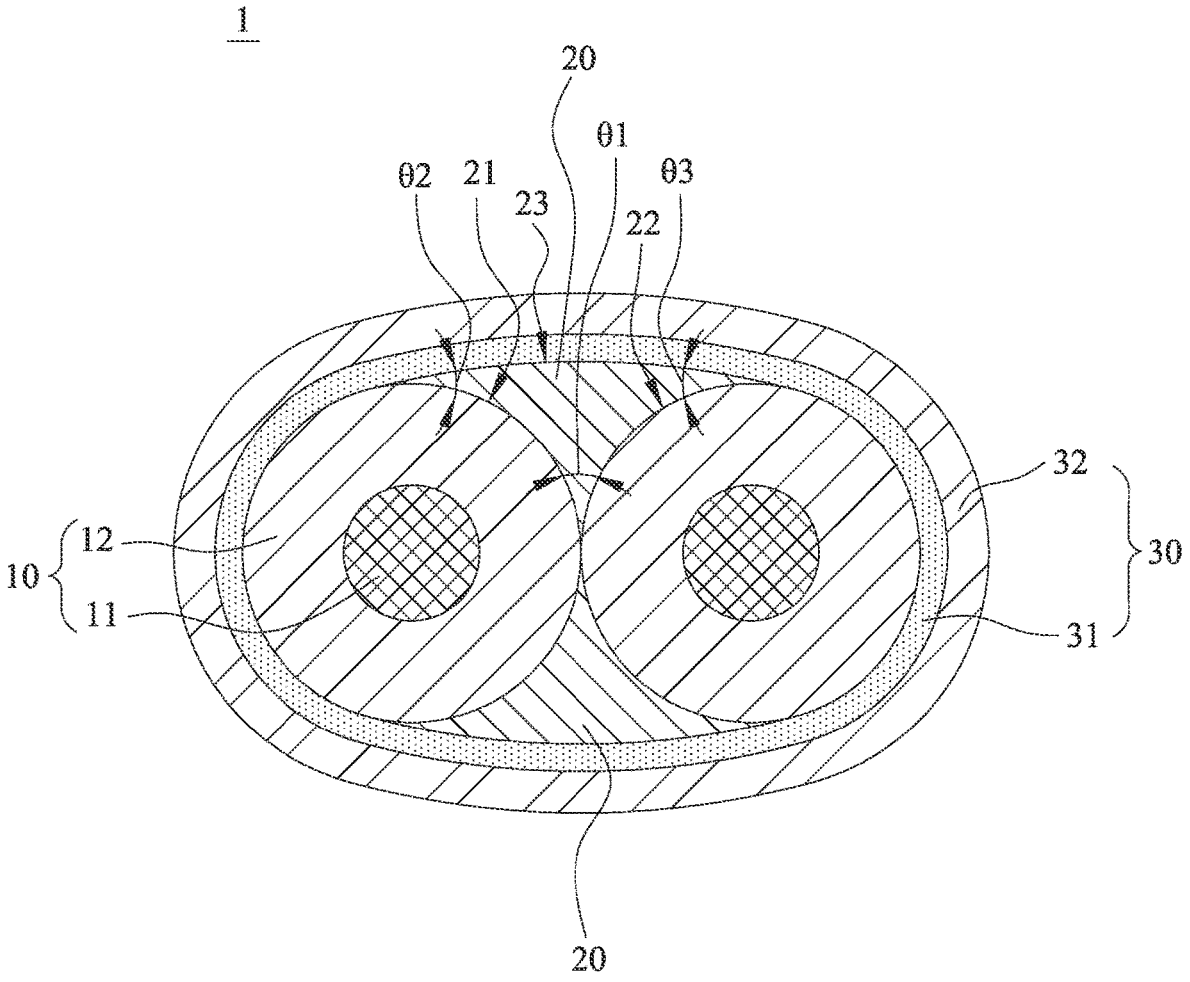
FIG. 2 is a cross-sectional view of the first embodiment of the cable of the present invention.

Referring to FIG. 2, FIG. 2 is a cross-sectional view of the first embodiment of the cable 1 of the present invention. The present invention provides a cable 1 with non-circular ground wire, which includes two wires 10, two ground wires 20, and an insulating tape 30. The inner sides of the wires 10 are in contact with each other. The ground wires 20 are respectively arranged on two opposite sides of the wires 10, and each ground wire 20 includes at least a first side surface 21, a second side surface 22, and a third side surface 23. The first side surface 21 and the second side surface 22 are complementary to and respectively in contact with the outer surfaces of the wires 10, and the shape of the first side surface 21 and the second side surface 22 of the ground wire 20 correspond to the outer surfaces of the wires 10, respectively. The insulating tape 30 covers the outer surfaces of the wires 10 and the third side surface 23 of the ground wires 20.

More specifically, each wire 10 includes a conductor 11 and an insulating layer 12, and the insulating layer 12 covers an outer surface of the conductor 11. The first side surfaces 21 and the second side surfaces 22 of the ground wires 20 respectively contact the outer surfaces of the insulating layers 12, and the shapes of the first side surfaces 21 and second side surfaces 22 of the ground wires 20 correspond to the shape of the outer surface of the insulating layers 12, respectively. The insulating layer 12 can provide a good insulating effect, and is made of materials, such as, preferably polytetrafluoroethylene. However, it is not limited to the above, and other common insulating materials can also be used as the material of the insulating layer 12. Each ground wire 20 is a conductor. The insulating tape 30 includes at least an inner layer 31 and an outer layer 32. The inner layer 31 covers the outer surfaces of the insulating layers 12 of the wires 10 and the third side surfaces 23 of the ground wires 20, and the outer layer 32 covers the outer surface of the inner layer 31. Preferably, the inner layer 31 is made of aluminum foil Mylar (Al-Mylar), and the outer layer 32 is made of polyethylene terephthalate (PET). However, the material of the inner layer 31 and the outer layer 32 is not limited to the above, and other insulating materials can also be used as the material of the inner layer 31 and the outer layer 32.

Based on the aforementioned structural configuration, the cross-section of each ground wire 20 presents a non-circular shape. The wires 10 and the ground wires 20 can contact each other by surfaces with matching shapes. The contact area is large, so that an excellent fit can be achieved. Therefore, during the process of covering the outer surfaces of the wires 10 and the third side surfaces 23 of the ground wires 20 with the insulating tape 30, although the tension of the insulating tape 30 will directly squeeze the wires 10 and the ground wires 20, the wires 10 and the ground wires 20 can be kept tightly in contact without loosening, deflection and deformation, so the wires 10 and the ground wires 20 are kept in stable relative position. Thereby, the cable 1 of the present invention can obtain the following effects: first, the signal heat loss is low, and the stability of high-frequency signal transmission is significantly improved; second, the overall structural strength is significantly improved; third, the structure provides better mechanical characteristics, such as, the cable 1 for better flexibility and bendability, and the wire 10 for better concentricity; fourth, the distance between the two conductors 11 is relatively stable, and hence the impedance variation is small to provide better impedance stability.

In the first embodiment, the cross-section of each wire 10 is circular, and the first side surface 21 and the second side surface 22 of each ground wire 20 are arc surfaces matching the wires 10. More specifically, the first side surface 21 and the second side surface 22 of each ground wire 20 are arc surfaces that are recessed inward, so as to match the shape of the outer surface of each wire 10. Therefore, the wires 10 and the ground wires 20 use arc surfaces as the contact surfaces, and the contact area is large, so that an excellent tightness can be obtained.

Preferably, the diameters of the two wires 10 are the same, and the arc lengths of the first side surface 21 and the second side surface 22 of each ground wire 20 are the same.

Preferably, the arc length of the first side surface 21 and the second side surface 22 of each ground wires 20 is equal to ¼ of the circumference of each wire 10. In other words, the first side surface 21 of the ground wire 20 is in contact with ¼ area of the outer surface of one of the wires 10, and the second side surface 22 of the ground wire 20 is in contact with the other wire 10 for ¼ of the outer surface area. Therefore, at least half of the outer surface of the wires 10 contact the first side surface 21 and the second side surface 22 of the ground wire 20, and the contact area is the large, so that the best bonding can be obtained, the heat dissipation effect is the best, the signal heat loss is the lowest, and the stability of the high-frequency signal transmission is the most outstanding.

Preferably, a first angle θ1 is formed between the first side surface 21 and the second side surface 22 of the ground wire 20, a second angle θ2 is formed between the first side surface 21 and the third side surface 23 of the ground wire 20, a third angle θ3 is formed between the second side surface 22 and the third side surface 23 of the ground wire 20. The first angle θ1 is greater than the second angle θ2 and the third angle θ3, and the second angle θ2 is equal to the third angle θ3. As such, the cross-section of each ground wire 20 has a non-circular shape such as a triangle with concave on both sides, which is similar to the shape of the space formed by the wires 10 and the insulating tape 30. Before the insulating tape 30 covers the outer surface of the wires 10 and the third side surfaces 23 of the ground wires 20, the space between the wires 10 and the insulating tape 30 is almost filled by the ground wires 20 so that the wires 10 and the ground wires 20 can be kept tightly coupled. Therefore, during the process of covering the outer surfaces of the wires 10 and the third side surfaces 23 of the grounding bodies 20 with the insulating tape 30, although the tension of the insulating tape 30 will directly squeeze the wires 10 and the ground wires 20, the wires 10 and the ground wires 20 can be kept tightly coupled and the relative positions remain unchanged. Furthermore, the cross-section of each ground wire 20 is symmetrical, so that the overall shape of the cable 1 of the present invention is symmetrical. Hence, the stability of high-frequency signal transmission and the overall structural strength of the cable 1 of the present invention can be significantly improved. At the same time, the structure provides better mechanical characteristics for reliability and reliability testing.

In the first embodiment, the shape of an inner surface of the insulating tape 30 corresponds to the shape of the combined outer surface of the wires 10 and the third side surface 23 of the ground wire 20. Specifically, the inner surface of the insulating tape 30 is the inner surface of the inner layer 31. Based on the above structural configuration, the wires 10 and the ground wires 20 can contact the insulating tape 30 in a surface contact manner with matching shapes of the contact surfaces of each other, and the contact area is large, so that an excellent tightness can be obtained. What's important is that during the process of covering the outer surfaces of the wires 10 and the third side surfaces 23 of the ground wires 20 with the insulating tape 30, even if the tension of the insulating tape 30 directly squeezes the wires 10 and the ground wires 20, the wires 10, the ground wires 20, and the insulating tape 30 can be kept tightly coupled.

Preferably, each wire 10 is circular, the third side surface 23 of each ground wire 20 is arc-shaped so that the overall combined outer surface is in contact with the inner surface of the insulating tape 30, and the insulating tape 30 is elliptical. In other words, the third side surface 23 of each ground wire 20 is a curved surface protruding outward, so that it can correspond to the shape of the inner surface of the insulating tape 30. Thereby, the wires 10, the ground wires 20, and the insulating tape 30 can use the arc surface as the contact surface, and the contact area is the largest, so that the best fit can be obtained, the heat dissipation effect is the best, the signal heat loss is the lowest, and the stability of high-frequency signal transmission is the most outstanding.

Figure 3:
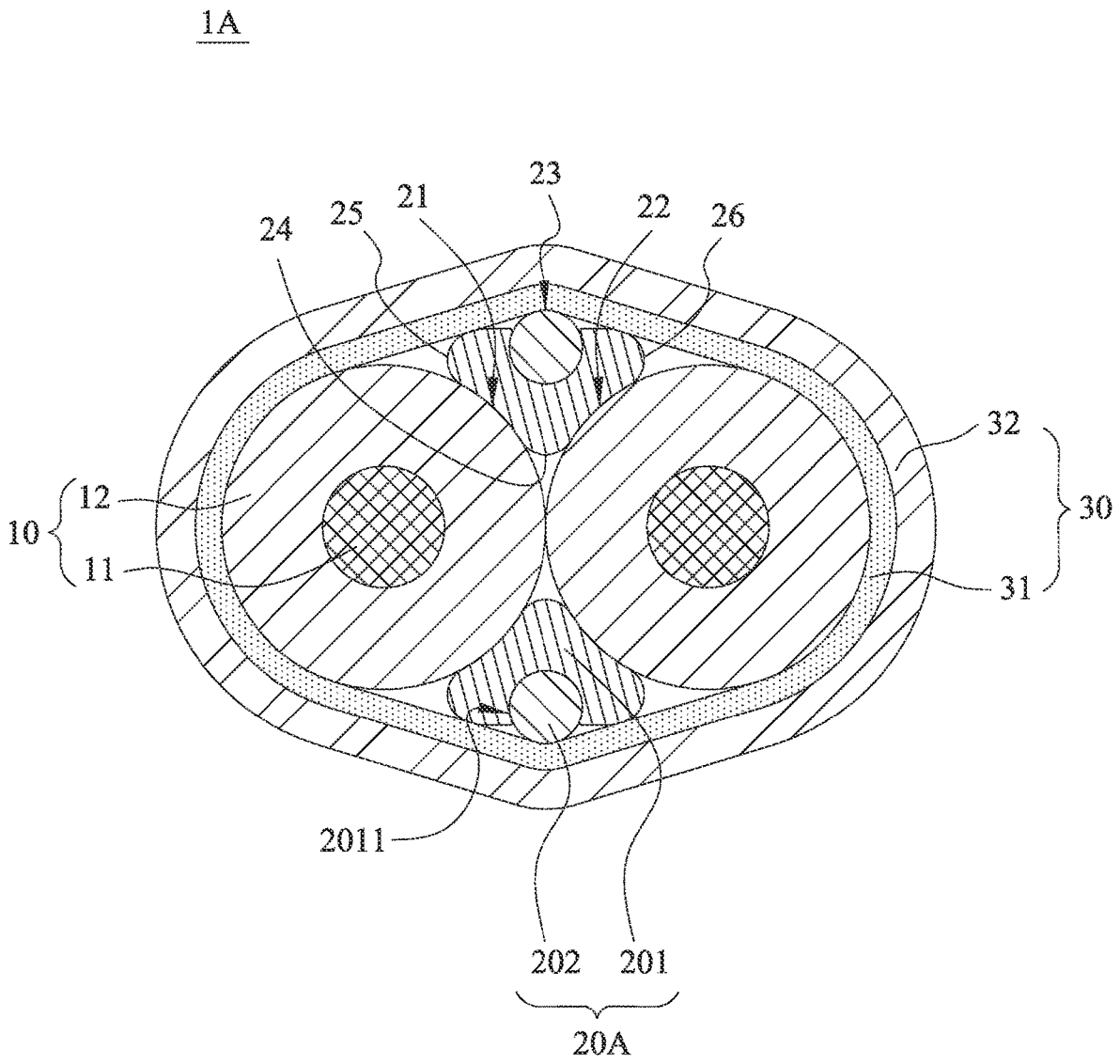
FIG. 3 is a cross-sectional view of the second embodiment of the cable of the present invention.

Refer to FIG. 3, which is a cross-sectional view of the second embodiment of the cable 1A of the present invention. The difference between the second embodiment and the first embodiment lies in: first, the arc length of the first side surface 21 and the second side surface 22 of each ground wire 20A is equal to ⅙ of the circumference of each wire 10; second, a first rounded corner 24 is formed between the first side surface 21 and the second side surface 22 of the ground wire 20A, a second rounded corner 25 is formed between the first side surface 21 and the third side surface 23 of the ground wire 20A, and a third rounded corner 26 is formed between the second side surface 22 and the third side surface 23 of each ground wire 20A, the first rounded corner 24, the second rounded corner 25, and the third rounded corner 26 have the same angle; third, the ground wire 20A includes a bushing 201 and a conductor 202, the bushing 201 has the first side surface 21, the second side surface 22, the first rounded corner 24, the second rounded corner 25 and the third rounded corner 26; fourth, a groove 2011 is recessed on one side of the bushing 201, the conductor 202 is embedded in the groove 2011 and protrudes from one side of the bushing 201, and one side of the conductor 202 and one side of the bushing 201 are jointly defined as the third side 23; fifth, the cross-section of the inner surface of the groove 2011 is curved, and the cross-section of the conductor 202 is round; sixth, the bushing 201 is made of polytetrafluoroethylene (PTFE), Polyethylene (PE) or Polyvinyl Chloride (PVC).

Accordingly, because the second embodiment uses the bushing 201 to reduce the volume of the conductor 202, and the bushing 201 is lighter in weight than that of the conductor 202, the weight of the cable 1A of the second embodiment is lighter than that of the first embodiment, which is conducive to the processing load of the terminal station.

Furthermore, the shape of the conductor 202 is no different from that of a general conductor, which means that the conductor 202 is a general conductor and can be purchased from the market. Therefore, as long as the bushing 201 is manufactured, and then the bushing 201 and the conductor 202 are assembled, the ground wire 20A of the second embodiment is complete, which is easy to manufacture.

In addition, materials such as polytetrafluoroethylene, polyethylene or polyvinyl chloride makes the bushing 201 easy to form a curved surface in the first side surface 21 and the second side surface 22, as well as easy to form the groove 2011.

In addition, compared with the first embodiment, the cross-section of the conductor 202 of the ground wire 20A of the second embodiment is circular, so it is cylindrical as a whole, and the tip discharge interference is lower.

In addition, compared with the first embodiment, the contact area between the conductor 202 of the ground wire 20A of the second embodiment and the inner surface of the insulating tape 30 is smaller, and hence, the fit is slightly less, the heat dissipation effect is slightly worse, the signal heat loss is slightly higher, and the stability of high-frequency signal transmission is slightly worse. However, it still outperforms the general ground wire.

Figure 4:
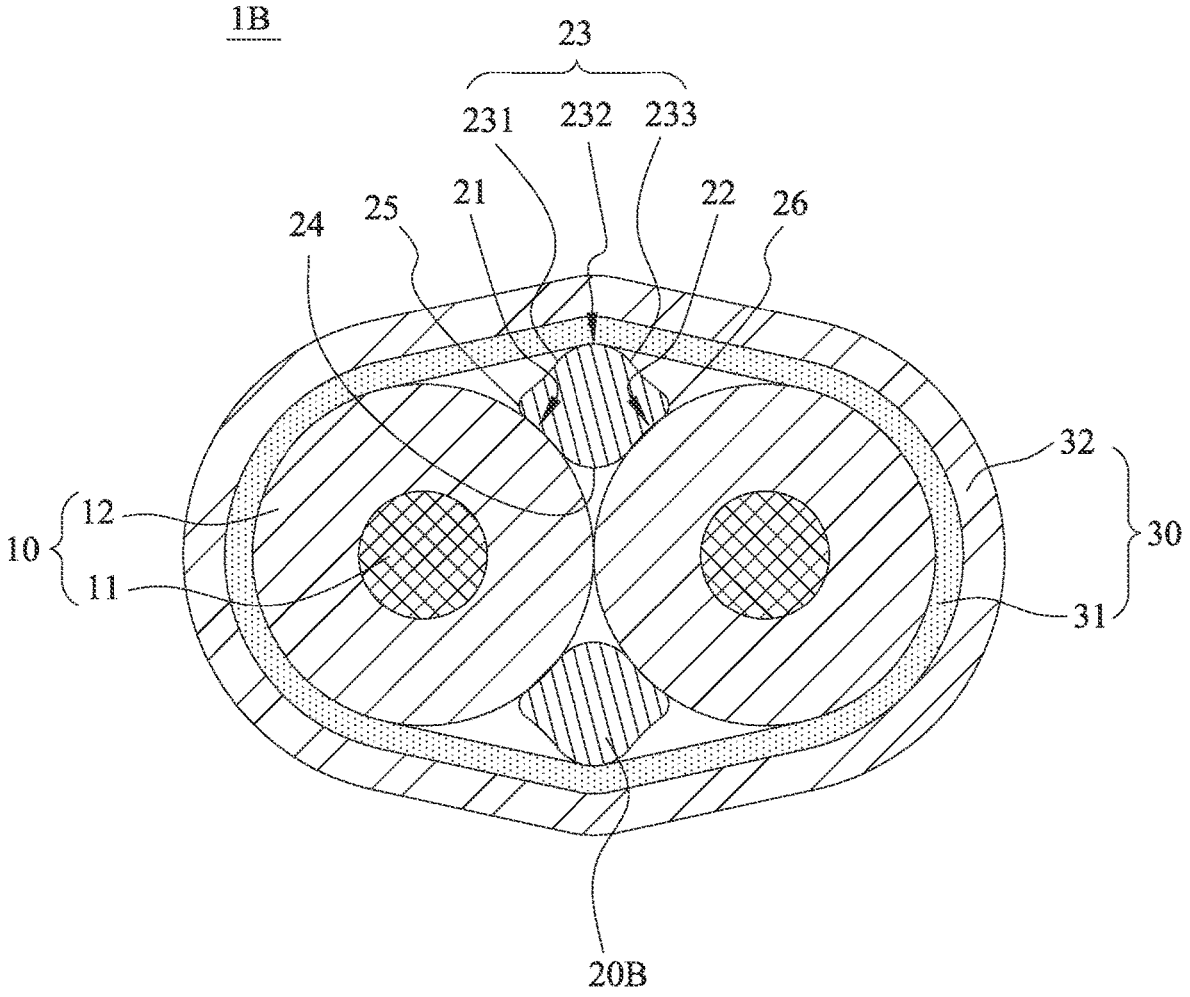
FIG. 4 is a cross-sectional view of the third embodiment of the cable of the present invention.

Refer to FIG. 4, which is a cross-sectional view of the third embodiment of the cable 1B of the present invention. The difference between the third embodiment and the first embodiment lies in: first, the arc length of the first side surface 21 and the second side surface 22 of each ground wire 20B is equal to 1/12 of the circumference of each wire 10; second, a first rounded corner 24 is formed between the first side surface 21 and the second side surface 22 of the ground wire 20B; the third side surface 23 of the ground wire 20B includes a fourth side surface 231, a fourth rounded corner 232, and a fifth side surface 233, a second rounded corner 25 is formed between the first side surface 21 and the fourth side surface 231 of the ground wire 20B, and a third rounded corner 26 is formed between the second side surface 22 and the fifth side surface 233 of the ground wire 20B; third, the first side surface 21 and the fifth side surface 233 of the ground wire 20B are positioned oppositely and have symmetrical shapes, and the second side surface 22 and the fourth side surface 231 of the ground wire 20B are positioned oppositely and have symmetrical shapes, the first rounded corner 24 and the fourth rounded corner 232 of the ground wire 20B are diagonal corners and have equal angles, the second rounded corner 25 and the third rounded corner 26 of the ground wire 20B are diagonal corners and have equal angles.

Accordingly, the cross-section of the ground wire 20B of the third embodiment is a non-circular but symmetrical shape such as a rhombus with four concave sides and four rounded corners, so that the ground wire 20B of the third embodiment is easy to process and produce.

Furthermore, compared with the first embodiment, the four rounded tips of the ground wire 20B of the third embodiment have lower tip discharge interference.

In addition, compared with the first embodiment and the second embodiment, the ground wire 20B of the third embodiment has an even smaller contact area with the inner surface of the insulating tape 30, the fit is the worst, and the heat dissipation effect is the worst, the signal heat loss is the highest, and the stability of high-frequency signal transmission is the worst, but still outperforms the general ground wire.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A cable with non-circular ground wires, comprising:

two wires, each of the two wires having a circular cross-section, the two wires being equal in diameter with inner sides of the two wires in contact with each other;

two ground wires, respectively arranged on two opposite sides of the two wires, each ground wire consisting of a conductor having a first side surface, a second side surface, and a third side surface; the first and second side surfaces being arc-shaped, complementary to and respectively in contact with outer surfaces of the two wires; and an insulating tape having an elliptical cross-section and covering the outer surfaces of the two wires and the third side surfaces of the two ground wires, the third side surface of each ground wire being arc-shaped and in contact with the insulating tape;

wherein a first acute angle is formed between the first side surface and the second side surface of each ground wire, a second acute angle is formed between the first side surface and the third side surface of each ground wire, a third acute angle is formed between the second side surface and the third side surface of each ground wire, the first acute angle is greater than the second acute angle and the third acute angle, and the second acute angle and the third acute angle are equal in size.

2. The cable with non-circular ground wires according to claim 1, wherein each of the first and second side surfaces is arc-shaped and has an arc length equal to 1/4 of the circumference of each of the two wires.

3. The cable with non-circular ground wires according to claim 1, wherein each of the two wires comprises a conductor and an insulating layer, the insulating layer covers an outer surface of the conductor of each of the two wires, the first side surface and the second side surface of each ground wire are respectively complementary to and in contact with an outer surface of the insulating layer of one of the two wires, and the insulating tape covers the outer surfaces of the insulating layers of the two wires and the third side surfaces of the two ground wires.

4. The cable with non-circular ground wires according to claim 1, wherein the insulating tape includes at least an inner layer and an outer layer; the inner layer covers the outer surfaces of the two wires and the third side surfaces of the two ground wires, and the outer layer covers the outer surface of the inner layer.

5. The cable with non-circular ground wires according to claim 4, wherein the inner layer is made of aluminum foil Mylar, and the outer layer is made of polyethylene terephthalate.

* * * * *